US005737885A

United States Patent [19]

Stoyke

[11] Patent Number: 5,737,885

[45] Date of Patent: Apr. 14, 1998

[54] SECONDARY INTERIOR WINDOW

[76] Inventor: Eckhart Albert Stoyke, Box 30, Site 4, R.R. #1, St. Albert, Alberta, Canada, T8N 1M8

[21] Appl. No.: 624,970

[22] Filed: Mar. 29, 1996

[51] Int. Cl.[6] ..... E06B 3/26

[52] U.S. Cl. ..... 52/202; 52/222

[58] Field of Search ..... 52/202, 208, 222; 49/61, 62, 463, 489.1

[56] References Cited

U.S. PATENT DOCUMENTS

| | | | |
|---|---|---|---|
| 4,189,880 | 2/1980 | Ballin | 52/202 |
| 4,193,235 | 3/1980 | Cucchiara | 52/202 |
| 4,233,790 | 11/1980 | Meadows | 52/202 X |
| 4,333,284 | 6/1982 | Meadows | 52/202 X |
| 4,453,585 | 6/1984 | Ruggeberg et al. | 52/202 X |
| 4,665,670 | 5/1987 | van den Burg | 5249/202 X |
| 4,666,206 | 5/1987 | Hough | 49/489.1 X |
| 4,763,452 | 8/1988 | Harvey | 52/222 X |
| 4,926,605 | 5/1990 | Milliken et al. | 52/222 X |
| 5,022,212 | 6/1991 | Lippolt | 52/222 X |
| 5,224,306 | 7/1993 | Cramer | 52/222 |
| 5,469,672 | 11/1995 | Fisher | 52/202 X |

*Primary Examiner*—Lanna Mai

[57] ABSTRACT

A secondary interior window includes a rectangular frame having a first face, a second face, and an exterior peripheral edge. A peripheral groove is disposed along the exterior peripheral edge of the rectangular frame. A sheet of transparent polymer plastic is stretched across one of the first face and the second face of the rectangular frame and disposed in the peripheral groove. A compressible retainer is embedded in the peripheral groove thereby preventing withdrawal of the sheet of transparent polymer plastic from the groove and securing the sheet of transparent polymer plastic to the frame. The compressible retainer protrudes from the peripheral groove, thereby providing an exterior friction member by means of which the frame is held within an interior window cavity.

1 Claim, 3 Drawing Sheets

SECTION A-A

SECONDARY INTERIOR WINDOW

FIELD OF THE INVENTION

The present invention relates to a secondary interior window.

BACKGROUND OF THE INVENTION

The heat loss from double glazed windows is 10 times greater than that of an equally sized area of outside wall insulated to R16. Existing methods to reduce the heat loss of windows by means of secondary retrofit interior windows inserted within an interior window cavity are costly or cumbersome to install or unsightly or require professional assistance for their installation.

One known method of creating an additional insulating dead air space in existing windows consists of attaching a double sided adhesive tape to an existing window frame and pressing a window foil against this adhesive surface. This method is rejected by most home or office building owners, in spite of its low material cost, because of the messy task of removing the sticky tape from the frame in the case of a damaged foil. This problem was addressed in U.S. Pat. No. 4,103,728 by providing an elongate narrow retainer moulding positioned along the peripheral frame portion of the window, including a narrow base portion having a flat surface intended for adhesive and permanent attachment to the frame. This moulding contains a concavely shaped groove in which the foil is retained by means of a non-compressible spline. U.S. Pat. No. 4,182,088 granted in 1980 describes preformed channels that are attached to an existing window to hold in place either a rigid pane or flexible foil. However, the permanent attachment of a channel or moulding to an existing window is considered a defacement of the window by many home and office building owners and prevents them from adopting such a solution. The installation of a movable non-transparent insulating system for a window by means of a friction fit using a compressible foam strip glued to the periphery of a frameless insulating board is described in U.S. Pat. No. 4,486,990 from 1982. This type of friction fit would require separate means of attaching the window foil. U.S. Pat. No. 4,676,024 from 1987 describes a removable storm window assembly containing a window pane, a perimeter frame and at least one side channel. A spring is used to force the side channel away from the window perimeter against the existing window jamb for a friction fit. The achievement of an air tight seal all around the retrofit frame is difficult to achieve with this arrangement in spite of its higher cost compared to the compressible bead solution. GB patent 2,187,782 finally describes a second window barrier that comprises a flexible sheet secured along all margins to a rigid frame. The sheet is secured by capping members. This invention limits the number of window foils to be added to two and is more expensive to realize. Alternately, it allows the installation of a single glass pane but no additional foils.

SUMMARY OF THE INVENTION

What is required is an alternative form of secondary interior window that is cost effective, easy to install and visually unobtrusive.

According to the present invention there is provided a secondary interior window which includes a rectangular frame having a first face, a second face, and an exterior peripheral edge. A peripheral groove is disposed along the exterior peripheral edge of the rectangular frame. A sheet of transparent polymer plastic is stretched across one of the first face and the second face of the rectangular frame and disposed in the peripheral groove. A compressible retainer is embedded in the peripheral groove thereby preventing withdrawal of the sheet of transparent polymer plastic from the groove and securing the sheet of transparent polymer plastic to the frame. The compressible retainer protrudes from the peripheral groove, thereby providing an exterior friction member by means of which the frame is held within an interior window cavity.

Although beneficial results may be obtained through the use of the secondary interior window, as described above, the insulating value is increased when an additional dead air space is created. Even more beneficial results may be obtained when a second peripheral groove is disposed along one of the first face and the second face of the rectangular frame. A second sheet of transparent polymer plastic is stretched across the rectangular frame and disposed in the second peripheral groove. A second compressible retainer is embedded in the second peripheral groove thereby preventing withdrawal of the second sheet of transparent polymer plastic from the second peripheral groove and securing the second sheet of transparent polymer plastic to the frame. Preferably the size of the dead air space between the first sheet and second sheet of transparent polymer plastic is maximized by having the first sheet of transparent polymer plastic stretched across the first face of the frame and the second sheet of transparent polymer plastic is stretched across the second face of the frame. This leaves an insulating air barrier between the first sheet of transparent polymer plastic and the second sheet of transparent polymer plastic.

Although beneficial results may be obtained through the use of the secondary interior window, as described above, in some applications it is preferable to have a protective shield of glass, so that children do not punch holes in the sheet of transparent polymer plastic. Even more beneficial results may, therefore, be obtained when the sheet of transparent polymer plastic is stretched across the second face of the frame. The first face of the rectangular frame has a peripheral notch along an interior edge. A pane of glass is positioned across the first resting in the notch. A retainer engages the pane of glass and the frame to secure the pane of glass within the notch. An insulating air barrier is thereby created between the sheet of transparent polymer plastic and the pane of glass.

Although beneficial results may be obtained through the use of the secondary interior window, as described above, it is possible to create a triple barrier utilizing two sheets of transparent polymer plastic and one pane of glass. Even more beneficial results may, therefore, be obtained when the second face of the rectangular frame has a peripheral notch along an interior edge. A second peripheral groove is disposed in the peripheral notch. A second sheet of transparent polymer plastic is stretched across the peripheral notch and disposed in the second peripheral groove. A second compressible retainer is embedded in the second peripheral groove thereby preventing withdrawal of the second sheet of transparent polymer plastic from the second peripheral groove and securing the second sheet of transparent polymer plastic to the frame.

As will be apparent from the above summary, this invention relates to a highly efficient retrofit secondary interior window that is installed inside a room in an existing interior window cavity by means of a friction fit. It consists of a frame onto which clear view plastic foils, preferably shrink foil, is attached by means of a compressible retainers, in the form of spline, mounted in a peripheral groove, or grooves in the case of multiple foils. A glass pane can be added to protect of the plastic window foil or foils against damage as may be required; for example, in schools. The mounting of the protective glass pane is achieved by placing the pane in a notch or recess in the frame in front of the foils and keeping it in place by means of a retainer profile that is inserted in a groove. The frame can be made of wood or from an extruded plastic profile.

The secondary interior window, as described, reduces heat losses of existing windows by 42% or more depending upon the configuration selected. The heat retention effect is created by dead air spaces between sheets of clear view plastic and/or glass. The number of dead air spaces selected determines the heat loss reduction. The friction fit between the frame of the secondary interior window and an existing window cavity, and the retention of the window foils is achieved with compressible splines secured in grooves of the retrofit frame. After installation of the shrink foil it is treated with a hot air blower to stretch it tight so as to be visually indistinguishable from a pane of glass. The window foils can be protected against damage by means of mounting a glass pane in front of the window foils in a recess provided for that purpose in the retrofit frame thus creating an additional dead air insulating space. Installation and repair can be done by untrained persons. The secondary interior windows, as described, will also provide advantages for air conditioning buildings during the hot summer months. It is, therefore, suitable both for cold and hot regions. The deterioration of window frames on the inside caused by ice formation and condensation on the glass pane and subsequent accumulation of water on the frame and window sill is avoided with this retrofit.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
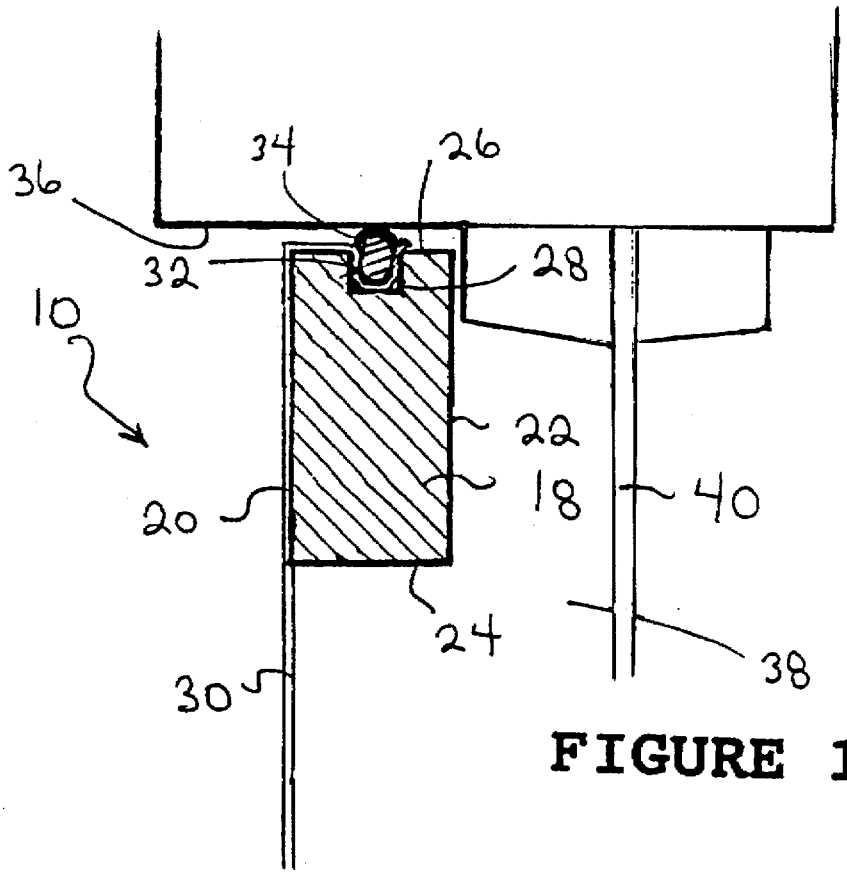
FIG. 1 is a side elevation view, in section, of a first embodiment of a secondary interior window constructed in accordance with the teachings of the present invention.
Figure 2:
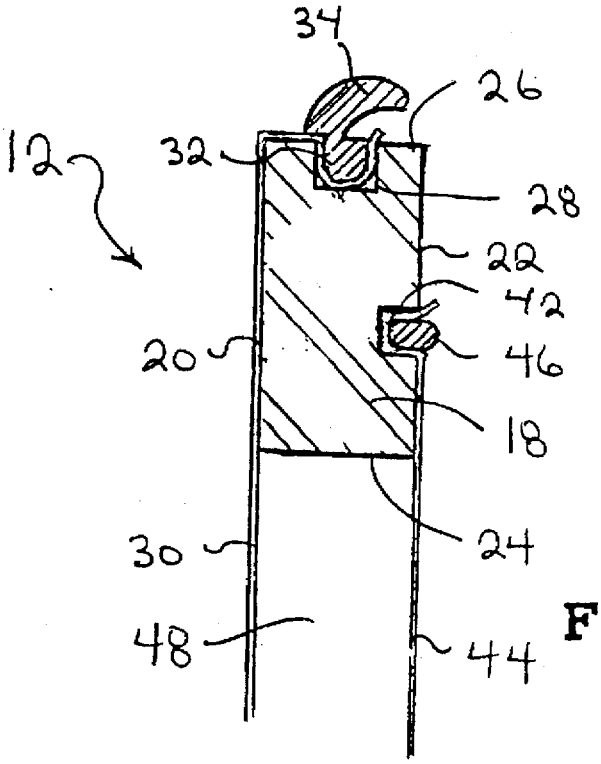
FIG. 2 is a side elevation view, in section, of a second embodiment of a secondary interior window constructed in accordance with the teachings of the present invention.
Figure 3:
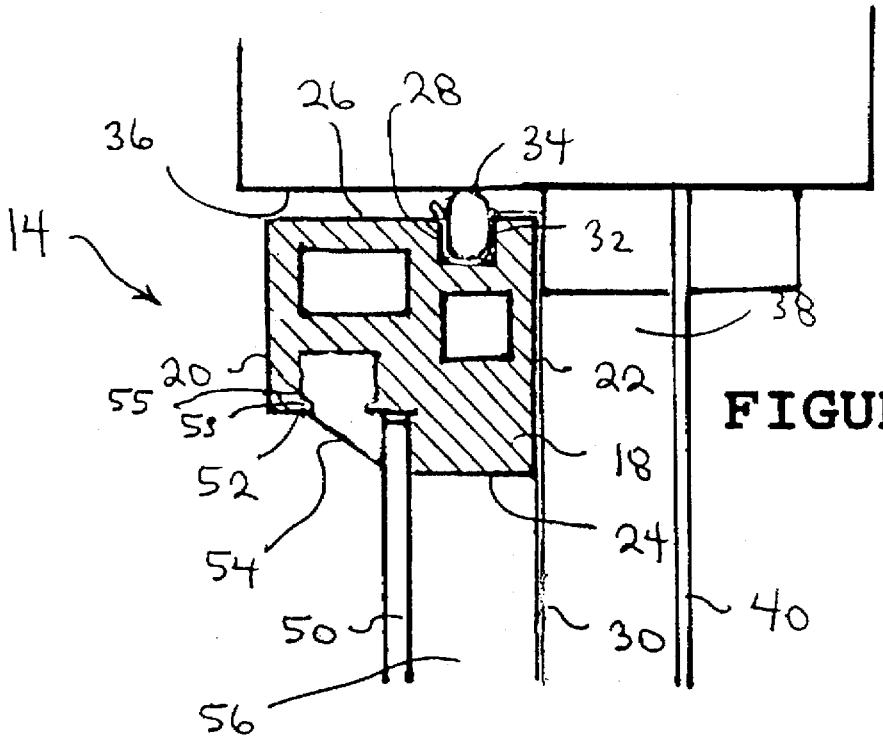
FIG. 3 is a side elevation view, in section, of a third embodiment of a secondary interior window constructed in accordance with the teachings of the present invention.
Figure 4:
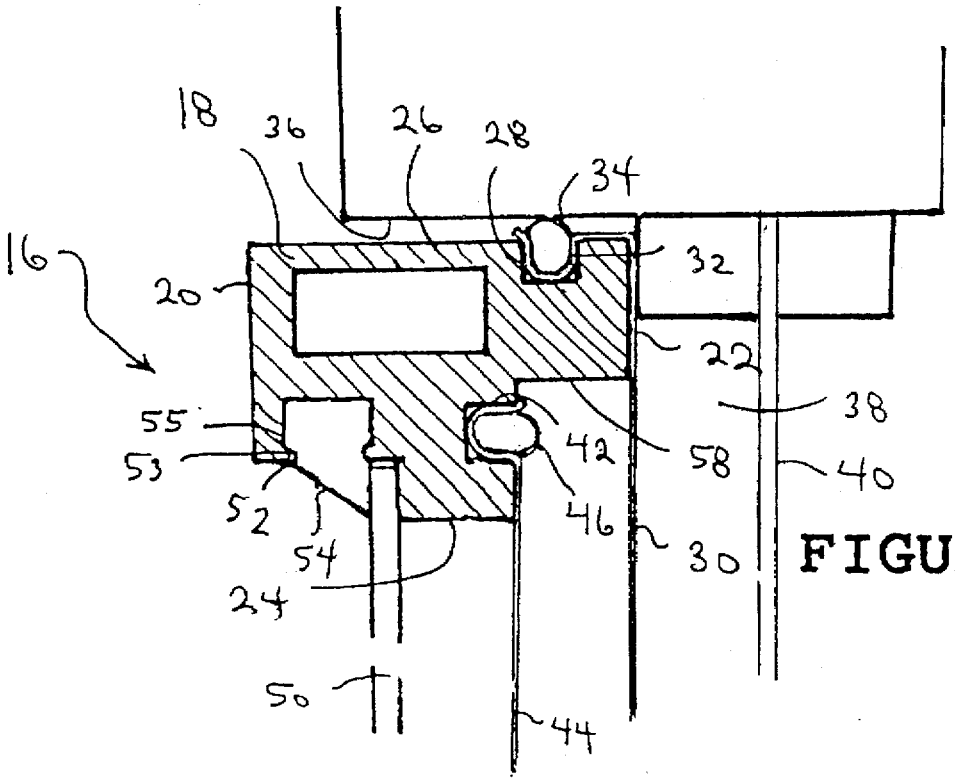
FIG. 4 is a side elevation view, in section, of a fourth embodiment of a secondary interior window constructed in accordance with the teachings of the present invention.

A plurality of embodiments of a secondary interior window will now be described with reference to FIGS. 1 through 6. A first embodiment, generally identified by reference numeral 10, is illustrated in FIG. 1. A second embodiment, generally identified by reference numeral 12, is illustrated in FIG. 2. A third embodiment, generally identified by reference numeral 14, is illustrated in FIG. 3. A fourth embodiment, generally identified by reference numeral 16, is illustrated in FIG. 4.

Referring to FIG. 1, first embodiment 10 includes a rectangular frame 18 having a first face 20, a second face 22, an interior peripheral edge 24 and an exterior peripheral edge 26. A peripheral groove 28 is disposed along exterior peripheral edge 26 of rectangular frame 18. A sheet of transparent polymer plastic 30 is stretched across first face 20 of rectangular frame 18 and disposed in peripheral groove 28. A compressible retainer 32 is embedded in peripheral groove 28, thereby preventing withdrawal of sheet of transparent polymer plastic 30 from peripheral groove 28 and securing sheet of transparent polymer plastic 30 to frame 18. A portion 34 of compressible retainer 32 protrudes from peripheral groove 28. Portion 34 serves as an exterior friction member by means of which frame 18 is held within an interior window cavity 36. A dead air space 38 is created between sheet of transparent polymer plastic 30 and window glass 40.

Referring to FIG. 2, with second embodiment 12 of the secondary interior window, a second peripheral groove 42 is disposed along second face 22 of rectangular frame 18. A second sheet of transparent polymer plastic 44 is stretched across second face 22 of rectangular frame 18 and disposed in second peripheral groove 42. A second compressible retainer 46 is embedded in second peripheral groove 42 thereby preventing withdrawal of second sheet of transparent polymer plastic 44 from second peripheral groove 42 and securing second sheet of transparent polymer plastic 44 to frame 18. With this configuration, an additional dead air space 48 is created between first sheet of transparent polymer plastic 30 and second sheet of transparent polymer plastic 44.

Referring to FIG. 3, third embodiment 14 of the secondary interior window utilizes a protective pane of glass 50. This prevents children from punching holes in sheet of transparent polymer plastic 30. In third embodiment 14, sheet of transparent polymer plastic 30 is stretched across the second face 22 of frame 18. First face 20 of rectangular frame 18 has a peripheral notch 52 along interior peripheral edge 24. Pane of glass 50 is positioned across first face 20 resting in notch 52. A retainer 54 engages pane of glass 50 and frame 18 to secure pane of glass 50 within notch 52. An insulating air barrier 56 is thereby created between sheet of transparent polymer plastic 30 and pane of glass 50.

Referring to FIG. 4, fourth embodiment 16 of the secondary interior window is a modified version of third embodiment 14 that creates a triple barrier utilizing two sheets of transparent polymer plastic 30 and 44 and one pane of glass 50. Second face 22 of rectangular frame 18 has a peripheral notch 58 along interior peripheral edge 24. Second peripheral groove 42 is disposed in peripheral notch 58. Second sheet of transparent polymer plastic 44 is stretched across peripheral notch 58 and disposed in second peripheral groove 42. Second compressible retainer 46 is embedded in second peripheral groove 42 thereby preventing withdrawal of second sheet of transparent polymer plastic 44 from second peripheral groove 42 and securing second sheet of transparent polymer plastic 44 to frame 18.

Referring to FIG. 2, the preferred structure for portion 34 of compressible retainer 32 is illustrated. The size of interior window cavity 36 can vary slightly. In some instances, interior window cavity 36 may be irregular, so the fit is tight in some areas with gaps in others. Portion 34 is preferably constructed to function as a living hinge and provide wide range of movement. The intention is that portion 34 will serve as an effective exterior friction member to hold frame 18 within interior window cavity 36, notwithstanding any gaps, irregularities or variations in the size of the opening.

Figure 5:
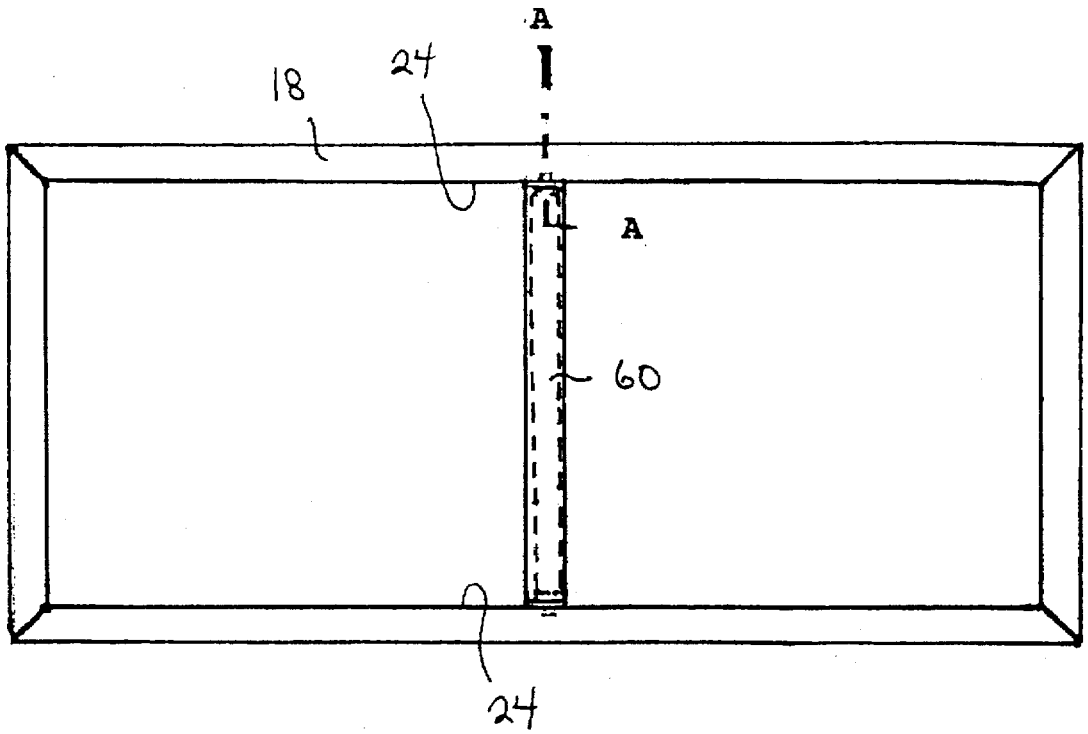
FIG. 5 is a front elevation view a secondary interior window constructed in accordance with the teachings of the present invention, to which internal bracing has been added.
Figure 6:
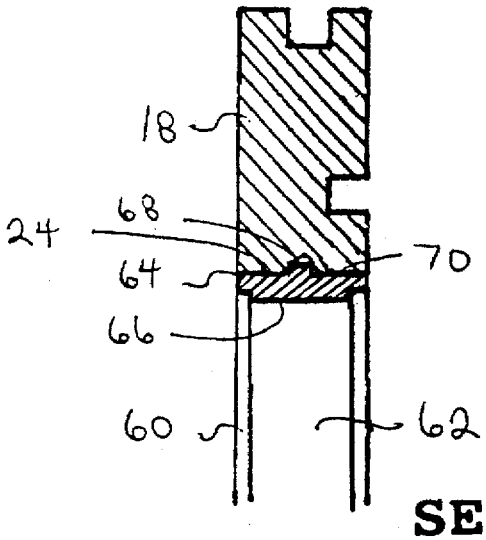
FIG. 6 is a side elevation view taken along section lines A—A of FIG. 5.

Referring to FIGS. 3 and 4, it is preferred that notch 52 have inwardly directed shoulders 53, which engage mating shoulders 55 on retainer 54. The reason this modification is desirable, is that is allows the same notch and retainer to be used with a further sheet of transparent polymer plastic, if a protective pane of glass is unnecessary for the application. In other words, pane of glass 50 is interchangeable with a further sheet of transparent polymer plastic, and it is the particular configuration of notch 52 and retainer 54 that makes it so. During the manufacturing process, the sheets of transparent polymer plastic are subjected to heat for the express purpose of causing them to shrink. When the sheets of transparent polymer plastic shrink they become taut on frame 18. This creates both a more aesthetically pleasing and functionally superior secondary interior window, due to the absence of wrinkles in the sheets of transparent polymer plastic. Problems can arise, however, when multiple sheets of transparent polymer plastic are used, for when the sheets shrink they can exert a sufficient force to distort frame 18. Referring to FIGS. 5 and 6, there is illustrated a preferred way of bracing and reinforcing frame 18. The positioning of a brace 60 is illustrated in FIG. 5. Referring to FIG. 6, brace 60 is of tubular construction and has an interior bore 62. Brace retainers 64 are used that have a stopper end 66 and a male retainer end 68, Stopper end 66 is insertable into interior bore 62 of brace 60. Male retainer end 68 is received in a notch 70 positioned in interior peripheral edge 24 of frame 18.

It will be apparent to one skilled in the art that modifications may be made to the illustrated embodiment without departing from the spirit and scope of the invention as hereinafter defined in the claims.

The embodiments of the invention in which an exclusive property or privelege is claimed are defined as follows:

1. A secondary interior window, comprising:

a rectangular frame having a first face, a second face, and an exterior peripheral edge;

a first peripheral groove disposed along the exterior peripheral edge of the rectangular frame;

a first sheet of transparent polymer plastic stretched across the first face of the rectangular frame and disposed in the first peripheral groove;

a first compressible retainer embedded in the first peripheral groove thereby preventing withdrawal of the first sheet of transparent polymer plastic from the first peripheral groove and securing the first sheet of transparent polymer plastic to the frame, the first compressible retainer protruding from the peripheral groove, thereby providing an exterior friction member by means of which the frame is held within an interior window cavity;

a second peripheral groove disposed along the second face of the rectangular frame;

a second sheet of transparent polymer plastic stretched across the second side of the rectangular frame and disposed in the second peripheral groove; and a second compressible retainer embedded in the second peripheral groove thereby preventing withdrawal of the second sheet of transparent polymer plastic from the second peripheral groove and securing the second sheet of transparent polymer plastic to the frame.

* * * * *